United States Patent [19]

Roussakis et al.

[11] Patent Number: 4,909,730

[45] Date of Patent: Mar. 20, 1990

[54] FLAME ARRESTER HAVING DETONATION-ATTENUATING MEANS

[75] Inventors: Nicholas Roussakis; Kenneth O. Lapp, both of Calgary, Canada

[73] Assignee: Westech Industrial Ltd., Calgary, Canada

[21] Appl. No.: 300,034

[22] Filed: Jan. 23, 1989

[51] Int. Cl.[4] ..... F23D 14/82

[52] U.S. Cl. ..... 431/346; 431/202; 138/42

[58] Field of Search ..... 431/202, 328, 346; 48/192; 60/39.11; 362/380, 164; 110/119; 138/42

[56] References Cited

U.S. PATENT DOCUMENTS

| | | | |
|---|---|---|---|
| 2,279,791 | 4/1942 | Lamb | 431/346 X |
| 2,774,351 | 12/1956 | Wiles | 431/346 X |
| 3,079,242 | 2/1963 | Glasgow | 431/346 X |
| 3,173,411 | 3/1965 | Corbin | 431/346 X |
| 3,748,111 | 7/1973 | Klose | 431/346 X |
| 3,918,889 | 11/1975 | Green | 431/346 |
| 4,613,303 | 9/1986 | Willis et al. | 431/346 |

FOREIGN PATENT DOCUMENTS

| | | | |
|---|---|---|---|
| 846966 | 9/1960 | United Kingdom | 431/346 |

*Primary Examiner*—Carl D. Price
*Attorney, Agent, or Firm*—Ernest Peter Johnson

[57] ABSTRACT

A flame arrester for a pipe line is provided comprising a detonation attenuator mounted within the arrester chamber between the quenching element and the backflash flame inlet. The attenuator is generally cup-shaped, aligned with the inlet, of greater diameter than the inlet but of lesser diameter than the arrester chamber, and is positioned close to the inlet so as to circumscribe it. The major portion of the high pressure central portion of a detonation wave generated by a backflash is received by the cup and reflected back into the pipe. Some of the detonation wave passes around the cup and impinges on the arrester element—however it has been delayed sufficiently to ensure complete quenching of the flame front in the element.

6 Claims, 7 Drawing Sheets

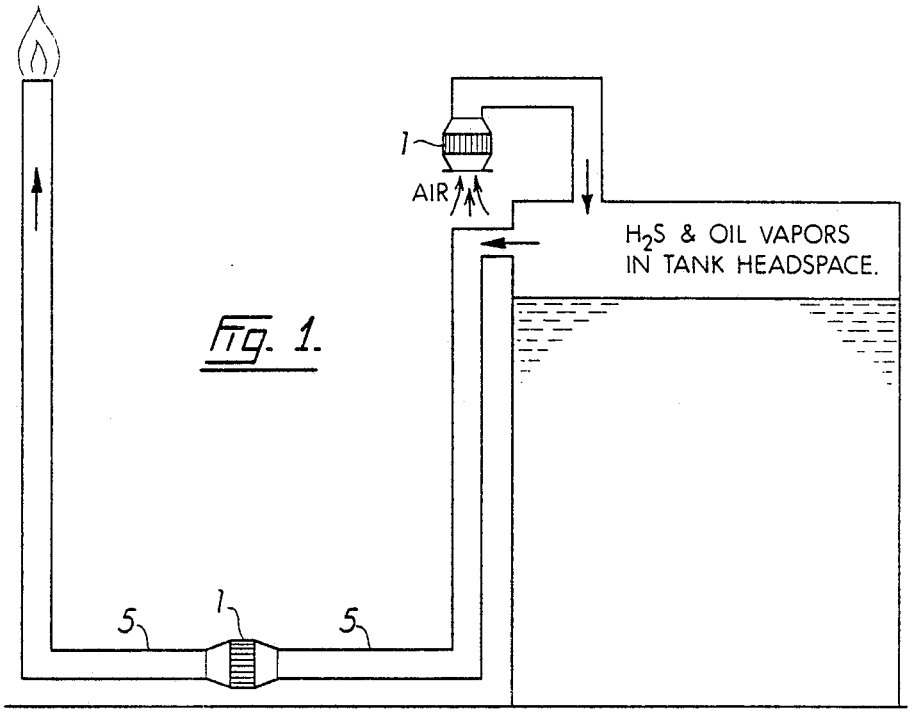
FIG. 1.
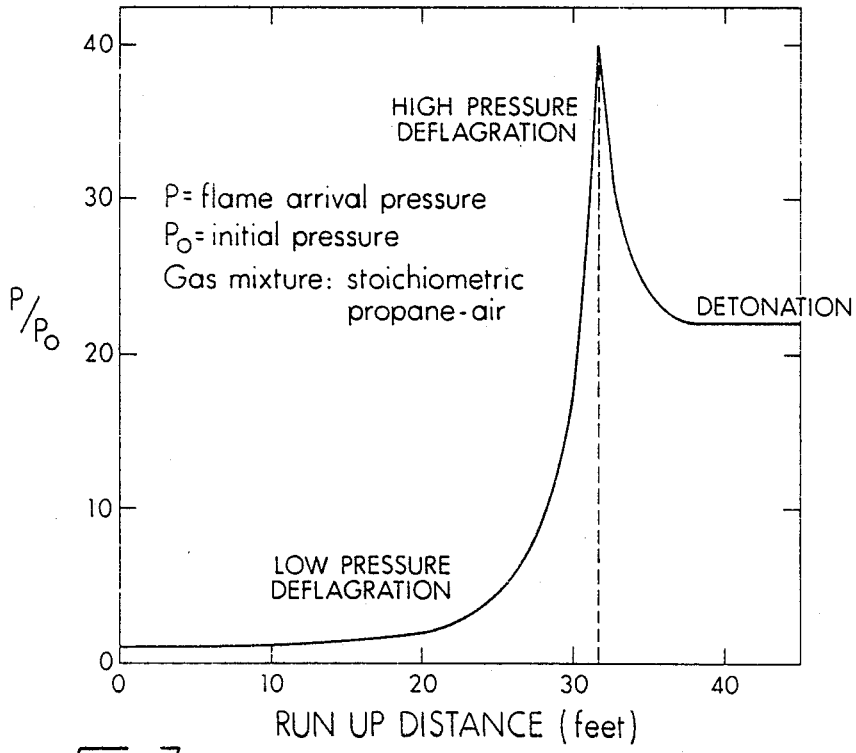
FIG. 2. Pressure of flame arriving at flame arrestor versus distance of ignition source from arrestor.

FLAME ACCELERATOR: 3 WASHERS (2.75" O.D. x 1.25" I.D.) EVENLY SPACED OVER 34", HELD TOGETHER BY 0.5" DIA. THREADED RODS.

(I) FLAME IONIZATION SENSOR (P) PRESSURE TRANSDUCER

FLAME ARRESTER HAVING DETONATION-ATTENUATING MEANS

FIELD OF THE INVENTION

The present invention relates to a flame arrester capable of arresting a flame front advancing through a pipe line. The arrester comprises means for attenuating a detonation in combination with means for quenching the flame.

BACKGROUND OF THE INVENTION

Flame arresters are commonly employed in pipe lines where the possibility of a backflash exists.

Backflash can occur where there is present a combination of three factors, namely: a flow of a flammable air/hydrocarbon gas mixture; confinement of the mixture within a pipe or other structure; and means for igniting the gas mixture. A typical example exists in the case of a flare line extending from an oilfield storage tank. A flammable gas mixture flows from the tank head-space through the line to a flare stack having an outlet to the atmosphere. The mixture leaving the flare stack outlet is normally kept lit. If the flow velocity at the stack is not sufficiently high, the flame can "backflash" or burn upstream through the pipe line. If the flame front reaches the tank, the latter can explode.

As stated, flame arresters have long been emplaced in such lines to snuff out or quench the flame front before it reaches an installation (such as the storage tank) where serious harm could be done.

Commonly, a flame arrester comprises a flanged tubular housing which is connected into the line to form an integral component thereof. An "element" is positioned within the bore or chamber of the housing to extend transversely fully across the bore diameter.

The element functions to quench the flame front.

In structure, the element usually comprises a matrix having a multiplicity of small diameter, elongate channels extending therethrough in the direction of the pipe axis. The matrix usually consists of metal. One typical element, for example, comprises a long flat sheet of aluminum, referred to as the "core". A second similar sheet is crimped in sawtooth fashion and the apexes of the crimps are in contact with the upper surface of the core sheet. The product is then spirally wound to produce a cylindrical element. An element of this type is commonly referred to as a "spiral wound crimped ribbon" element.

As stated, the channels of the element are minute in width or diameter. More specifically, the channel diameter is selected to be smaller than the "quenching diameter". The quenching diameter is the largest diameter at which a flame within the channel would be extinguished under static flow conditions. The determination of the quenching diameter is commonly carried out in the industry in accordance with the practice outlined in "Progress in Combustion Science and Technology", Potter, A. E. Jr., Volume 1, pages 145–181 (1960).

In principle then, a flame arrester element is provided with small enough channels, established by determination in accordance with standard industry practice, so that sufficient heat will be removed from a flame, by conductance through the matrix material, to cause the flame to be extinguished.

Unfortunately, in practice, flame arresters do from time to time fail to arrest the flame and explosions do occur as a result, even though they have been designed in accordance with established and industry-accepted practice.

The reason for failure, in applicant's view, is that the conventional flame arresters are only capable of coping with a limited part of the spectrum of flame propagation conditions to which they may be exposed, when used outside existing standards.

Flame propagation can occur in two modes, deflagration and detonation.

Deflagration is a combustion wave that propagates by the transfer of heat and mass to the unburned gas ahead of it. Associated flame front overpressures can range from 0 to 10 or 20 times the initial value (which is commonly atmospheric pressure). Flame velocities are usually subsonic for deflagrations.

Detonation is a combustion wave that propagates by shock compression-induced ignition. Detonations travel supersonically, with Mach numbers of 5 to 10. Detonation overpressures typically reach 15 to 50 times the initial value.

Under a suitable and complex combination of circumstances (including gas composition, length of run from the ignition source, and flame front turbulence-creating factors such as bends and the like), an advancing flame front can accelerate and change from the deflagration mode to the detonation mode. Detonation is evidenced by a rapid and sharp escalation in the pressure accompanying the flame front, said peak pressurewave being in spaced relationship in front of the flame front. A typical pressure/distance plot based on a burn involving detonation in a pipe is set forth in FIG. 2, following below, and shows the spectrum of pressure change that occurs as a flame front transition takes place between modes.

When flame propagation incurs detonation, two undesirable results can occur, namely:

- combustion may be initiated on the protected or upstream side of a conventionally designed element; and
- the element may be structurally damaged and thereafter lose some of its arresting capability.

These problems associated with detonation have been acknowledged in the prior art literature.

In reviewing the literature, applicant noted two different theories of interest given to explain the failure of arresters when exposed to detonation. One theory suggested that the high pressure of detonation would propel hot gas through the channels at such high velocity that the conventionally designed element would be incapable of cooling the gas sufficiently. On reaching the upstream end of the element, the still-hot gas would combine with the unburned gas and heat it so that spontaneous ignition would occur. The other theory suggested that the high pressure would densify the flammable gas mixture in the channels so that flame advancing through the channels would create so much heat that the matrix heat sink would be incapable of preventing the flame from reaching the upstream end of the channels.

Two modifications of an arrester element readily suggest themselves from these theories, as a means for coping with the high pressure failures. More particularly, one could:

- reduce the width of the channels; or
- further elongate the channels;

to thereby increase the heat-removal capability of the element.

Reducing the channel width or diameter is a solution of only limited applicability or practicality. As the channel diameter is reduced, the pressure drop across the element increases. Choking a vent line in this fashion is undesirable. So that leaves elongation of the channels as an avenue to explore.

Applicant constructed and tested an element having a channel length 16 times that of a commercially available element designed in accordance with conventional practice. When subjected to detonation conditions, this extended element still failed over a significant portion of the flame propagation spectrum. Thus channel elongation does not appear to solve the problem of failure at high pressure, at least in a practical and feasible fashion.

Another possible modification for the element has been suggested in the prior art, to improve quenching capability. This involves providing channels which are tortuous in configuration and have alternating sections of expanded and reduced diameter. Channels of this design cause the flame front to move turbulently.

Applicant tested elements having such turbulence-creating channels and found that they do provide improved quenching. However, when subjected to the high pressures approaching or accompanying detonation conditions, the elements still failed with some regularity.

So there is still a need for a flame arrester which is improved with respect to handling the full spectrum or range of flame propagation conditions, including detonation.

SUMMARY OF THE INVENTION

In accordance with the invention, a detonation attenuator is provided within the housing of a flame arrester. The attenuator is positioned in front of the quenching element, to receive and reflect part of the central portion of the detonation wave back into the pipe. Only a portion of the detonation wave passes around the attenuator and accompanies the flame to the element. By incorporating an attenuator of successful design, an arrester is provided which has been tested and shown to be much improved in coping with a full spectrum of flame propagation conditions.

The modified flame arrester involves, in combination:

A housing whose internal chamber has a greater cross-sectional area than that of the pipe line, so there is expansion of the shock wave/flame front as it enters the chamber; and A generally cup-shaped attenuator or member, positioned in line with and adjacent to the housing flame front inlet, for receiving and reflecting part of the detonation wave back down the pipe. The attenuator side wall is inwardly spaced from the longitudinal wall of the housing to thereby form an annular passage connecting the flame front inlet with the quenching element. The peripheral portion of the shock wave/flame front train passes through this passage to the element, wherein the flame is quenched.

The combination has the following advantages:

The element is protected by the attenuator from structural damage from detonation, to a much improved extent. In test runs without an attenuator, the element was rendered ineffective after as few as 3 detonations. When tested with the attenuator in place, the same type of element was able to withstand as many as 25 detonations without significant damage;

The combined components performed to quench detonations. When tested under similar conditions against several commercially available flame arresters, the new arrester was successful in quenching on every run while the other units failed on some runs, as shown later in this specification. Stated otherwise, the present arrester performed successfully over the full spectrum of wave propagation at the test conditions; and In applications where the flame arrester is used in situations where the flow and the potential flame front approach from the same direction, the attenuator can serve to protect the element from velocity erosion or degradation from collision by solid objects in the line. Velocity erosion occurs when fine particles carried in a high velocity gas flow strike the element.

Broadly stated, the invention is a flame arrester for arresting the advance of a flame front through a pipe line, comprising: a generally tubular housing adapted to be connected with the pipe line, whereby the housing forms an integral component thereof, said housing forming an inlet for a flame front advancing through the pipe line and an outlet, said housing thus forming an open-ended chamber; element means, positioned in the chamber at its outlet end and extending transversely across the housing chamber, for quenching the flame attempting to pass therethrough; and a generally cup-shaped member, positioned in the chamber in line with and adjacent to but spaced from the inlet, said cup-shaped member having a solid end wall extending transversely across the inlet and a side wall, said side wall being spaced inwardly from the longitudinally extending wall of the housing, to form an annular passage therewith, said cup-shaped member having its mouth directed toward the inlet, said cup-shaped member being operative to receive the central portion of a detonation wave entering the chamber and to reflect part of it back into the pipe line.

DESCRIPTION OF THE DRAWINGS

FIG. 1 is a schematic side view showing a pair of flame arresters in use in a typical application, namely in the flare and air lines of an oil storage tank;

FIG. 2 is a plot of pressure versus run-up distance for a typical pressure profile generated in a burn down a pipe line in accordance with FIG. 13, said burn involving both deflagration and detonation modes;

DESCRIPTION OF THE PREFERRED EMBODIMENT

In General

Figure 3:
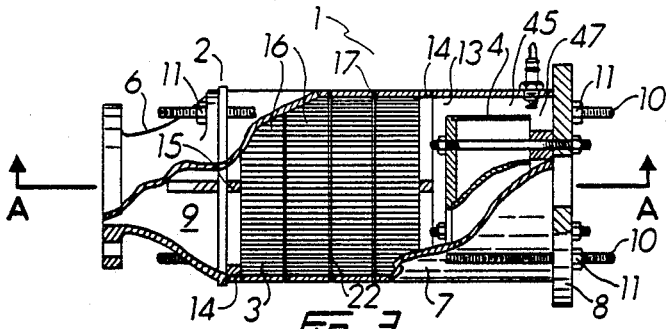
FIG. 3 is a partly broken away side view of one form of the arrester.
Figure 4:
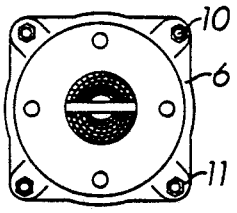
FIGS. 4 and 5 are end views of the arrester of FIG. 3.
Figure 5:
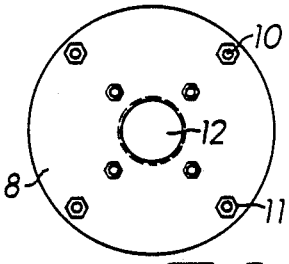

The flame arrester 1 comprises a generally tubular housing 2, a quenching element 3, and a cup-shaped member or cup 4. The housing 2 is adapted to be connected into a pipe line 5 to form a flow component thereof. The element 3 and cup 4 are positioned within the housing 2.

The Housing

The housing 2 is a multi-component assembly which consists of a flanged upstream end member 6, a tubular middle member 7 (made up of rings), and a downstream flange member 8. ("upstream" and "downstream" refer to the direction of flow of the gas passing through the line 5.)

The upstream end member 6 forms a central bore or passage 9 for communication with the bore of the upstream end of the pipe line 5. It will be noted that the member 6 is outwardly flared, so that the diameter of the bore 9 is greater than that of the pipe line 5. The member 6 also forms suitable openings around its periphery for receiving threaded tie rods 10 which, in cooperation with nuts 11, hold the members 6, 7, 8 together.

The downstream flange member 8 also forms peripheral openings for receiving the tie rods 10. The member 8 forms a central threaded bore or flame inlet 12 which enables the member to be screwed onto the threaded downstream end of the pipe line 5. This bore 12 forms the flame front inlet for the arrester 1.

When the three members 6, 7, 8 are assembled using the tie rods 10 and nuts 11, the housing 2 forms an open-ended internal chamber 13, which provides a gas flow passage through the unit when it is connected into the pipe line 5. The diameter of this chamber 13 is greater than or expanded relative to the diameter of the pipe line bore.

The Quenching Element

The quenching element 3 is positioned in the upstream end of the housing chamber 13.

Figure 6:
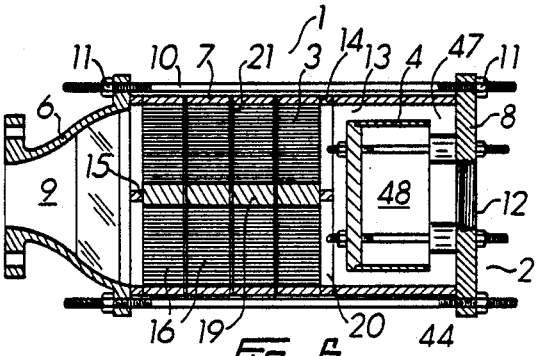
FIG. 6 is a fully sectional plan view of the arrester of FIG. 3, taken along the line A—A.
Figure 7:
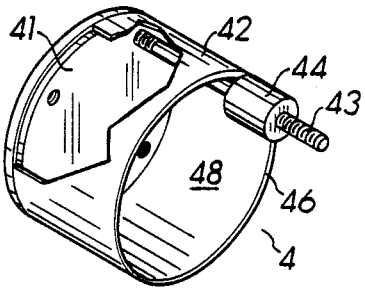
FIG. 7 is a perspective partly-broken-away view of the attenuator or cup-shaped member of FIGS. 3 and 6.
Figure 8:
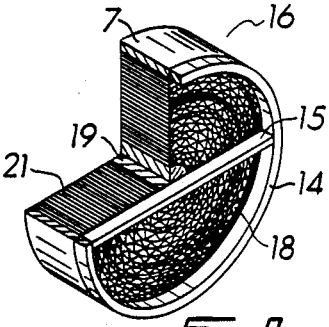
FIG. 8 is a perspective view of a crimped ribbon quenching element, partly broken away to illustrate the quenching channels.
Figure 9:
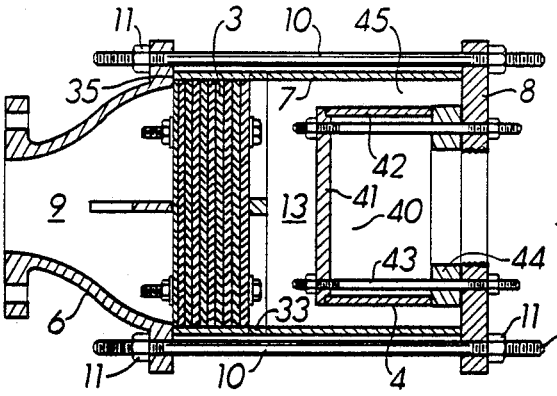
FIG. 9 is a sectional side view of an arrester having a preferred form of element consisting of a stack of expanded metal sheets.
Figure 10:
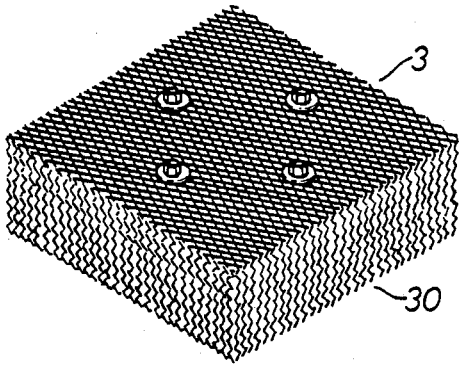
FIG. 10 is a perspective view of the element stack of FIG. 9.
Figure 12:
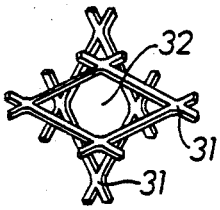
FIG. 12 shows a fragment of two superimposed sheets of expanded metal stacked in alternating orientation, showing the 90° rotation of the diamond-shaped openings.
Figure 11:
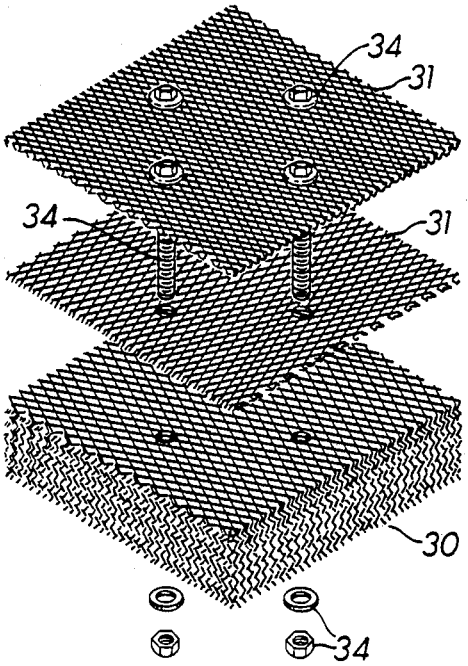
FIG. 11 is a perspective view showing the element stack of FIG. 10 in a partly exploded form.

In the embodiment shown in FIG. 6, the element 3 comprises upstream and downstream rings 14 and crossbars 15 holding four discrete element segments 16 and spacers 17 positioned between them in end-to-end formation. Each element segment 16 has a conventional spiral-wound crimped ribbon 18 wound around a core 19 and contained within a ring 20 which is part of the housing middle member 7. The solid material (or "matrix") of the ribbon 18 forms a multiplicity of small width, elongate, discrete channels 21. The channels 21 extend in the direction of the longitudinal axis of the housing chamber 13. The width or diameter of these channels 21 is selected to be smaller than the quenching diameter, when determined in accordance with standard industry practice for the conditions involved.

It will be noted that the spacers 17 maintain a slight gap 22 between each element segment 16. These gaps 22 provide expansion zones for gas in the channels 21 and lead to turbulent flow of that gas.

A preferred form of quenching element is shown in FIGS. 9–12. This element comprises a stack 30 of sheets 31 of expanded metal forming a multiplicity of diamond-shaped channels 32. The sheets 31 are oriented in alternating fashion so that the major dimension of the channels 32 of one sheet 31 is crosswise to the major dimension of the channels of the next sheet. Stated otherwise, each sheet 31 is rotated 90° relative to the next sheet in alternating fashion. This is particularly shown in FIG. 12.

Ring-like end plates 33 are provided at each end of the stack 30. Nut and bolt assemblies 34 extend through the end plates 33 and sheets 31 and hold the stack 30 together. The tie rods 10 also extend through the assembly and clamp it against the inner shoulder 35 of the upstream end member 6.

The Attenuator

The attenuator comprises a cup-shaped member or cup 4 having a solid end wall 41 and a tubular side wall 42. The cup 4 is fixed in place in line with and adjacent to the flame inlet 12. More particularly, threaded rods 43 extend through the cup end wall 41 and flange member 8. Spacers 44 cooperate with the wall 41 and member 8 to fix the cup 4 in place.

As shown, the side wall 42 of the cup 4 is inwardly spaced from the longitudinal wall of the housing middle member 7. There is thus formed an annular passage 45 therebetween. The mouth 4*a* of the cup 4 is directed toward the flame front inlet 12. It will also be noted that the rim 46 of the cup 4 is spaced a short distance (the "stand-off") from the downstream flange member 8. The annular passage 45 communicates with the stand-off space 47 to form an L-shaped path past the cup 4. It will further be noted that the diameter of the bore 48 of the cup 4 is greater than the diameter of the flame inlet 12. Stated otherwise, the cup 4 encircles the flame inlet 12.

Before describing the observed operation of the present arrester, it is useful to describe the nature of a detonation wave. To applicant's understanding, it comprises three different zones or segments. These are: a shock wave, a following induction zone, and then a reaction zone. These zones are fancifully illustrated in FIGS. 14*a–d*. The shock wave is responsible for the compression and heating of the unburned gas. The induction zone represents the region extending back to the point at which exothermic release begins in the hot, pressurized gas. And the reaction or flame zone represents the region wherein exothermic reaction is initiated and completed.

Applicant's understanding of the process proceeding in the present arrester is as follows:

When there is a detonation, the detonation wave advances through the pipe line 5. On entering the chamber 13, the wave expands radially. The strong central portion of the wave proceeds into the bore 48 of the cup 4 and a significant portion is reflected by the cup 4 back down the pipe line. Only the weaker peripheral portion of the shock wave accompanies the flame through the L-shaped passage 47, 45 to the element 3, where the flame is quenched.

The pressure associated with the peripheral portion of the shock wave that bypasses the attenuator is considerably lower than that associated with the central portion. The annular or peripheral portion no longer appears to propagate as a detonation.

Applicants' tests have indicated:

That in the absence of the attenuator, a flame front in the detonation mode will usually penetrate through the conventionally designed quenching element and ignite gas upstream thereof;

That, when using the same element and test conditions but with the attenuator in place in the arrester, the flame front does not penetrate beyond the arrester and ignite the upstream gas;

That, in the absence of the attenuator, the element becomes damaged in the course of a few detonation tests; and That, with the attenuator in place, the same element under the same test conditions, is not damaged.

The invention is supported and illustrated by the following examples:

EXAMPLE 1

This example shows that a flame arrester having an attenuator and a conventional quenching element, in accordance with the invention, successfully arrested an air/propane flame front at both deflagration and detonation conditions. The burn runs were carried out in the test assembly shown in FIG. 13.

| Test Conditions | |
|---|---|
| quenching element: | aluminum crimped metal ribbon, 0.050 inch crimp height, round spiral wound, 8 inch path length; |
| downstream (burn end) piping | straight run, 35 feet, 3" schedule 80 steel pipe, threaded to arrester, 10 ignition location points tapped into pipe, for use with a spark plug ignitor; |
| housing detail | chamber 7" long with 8" diameter; |
| gas mixture | 4.6% propane-air; |

The test procedure was as follows:

The propane and air were metered into the downstream pipe;

The mixture composition was monitored with a gas chromatograph to ensure propane concentration accuracy;

The pipe system was purged with the mixture and ignited. Different runs were ignited at different distances from the arrester. (Ignition location was important to all of these tests. The explosion pressures experienced by the flame arrester tended to increase as the burn distance was increased. More particularly, starting from the ignition point closest to the flame arrester, the deflagration pressure increased with increasing distance from the flame arrester flame inlet. After a certain point (ignition location #7), a flame front passed through the deflagration/detonation transition zone with only detonations occurring when longer run-up distances were thereafter used.)

Figure 13:
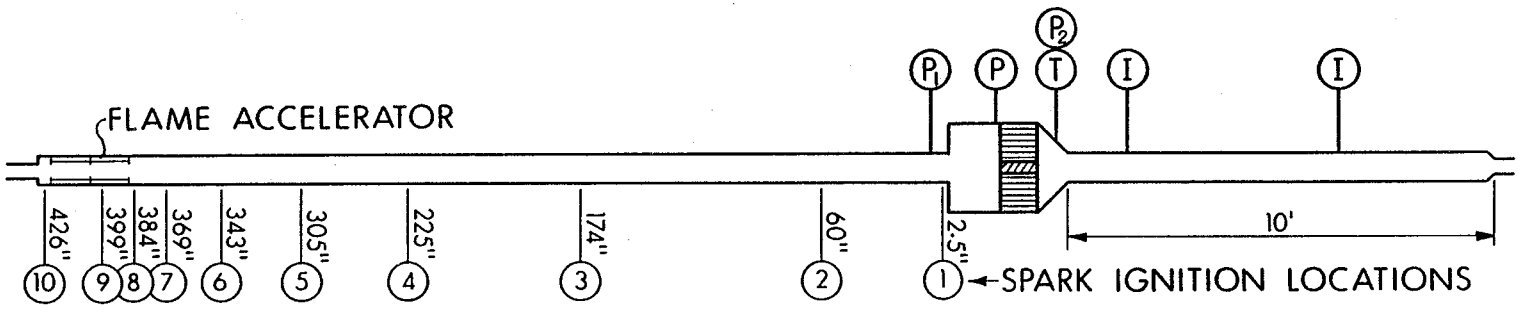
FIG. 13 is a schematic of the test circuit used to develop the data set forth in the Examples.
Figure 14A:
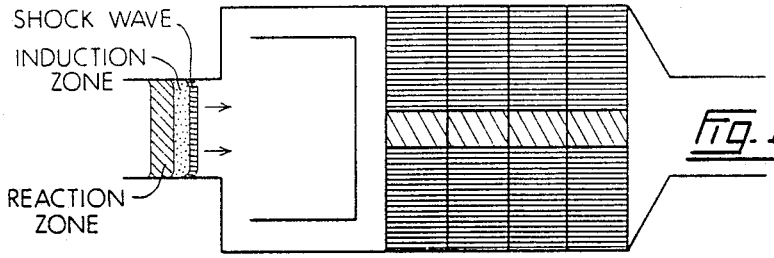
FIGS. 14*a* to 14*d* are fanciful simplified representations of the arrester and the process of detonation arrestment believed to occur in it.
Figure 14B:
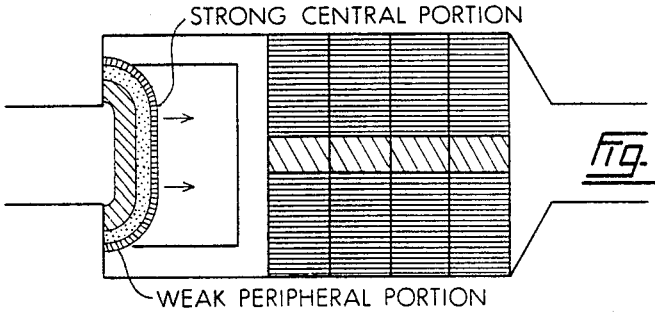
Figure 14C:
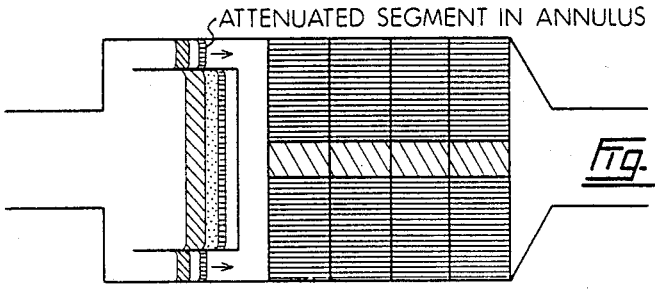
Figure 14D:
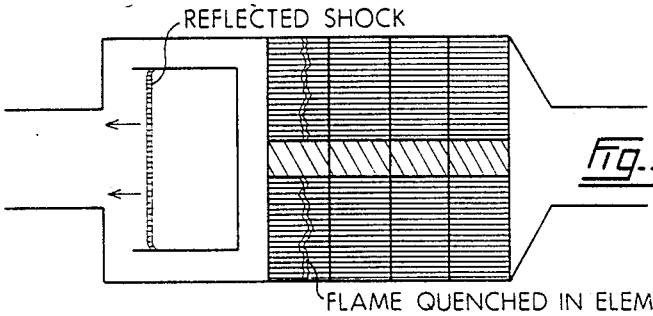

Flame arrester failure (i.e. flame propagation on the protected side) was determined by flame ionization sensors, as shown in FIG. 13.

The test results were as follows.

Figure 15:
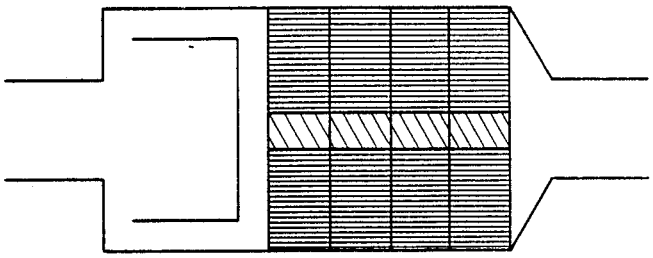
FIGS. 15 and 16 show schematically the identical arresters, one with attenuator and one without, used to develop the data of Example 1.

Having reference to FIG. 15, there is shown a schematic of an arrester A in accordance with the invention, having a cup-shaped attenuator. The arrester A was repeatedly tested as set forth in Table I on the test circuit of FIG. 13 and the flame was quenched on every test.

TABLE I

| Ignition Locations | 1 | 2 | 3 | 4 | 5 | 6 | 7 | 8 | 9 | 10 |
|---|---|---|---|---|---|---|---|---|---|---|
| Number of Ignitions | 10 | 10 | 10 | 10 | 10 | 10 | 10 | 30 | 10 | 10 |
| Number of Failures | 0 | 0 | 0 | 0 | 0 | 0 | 0 | 0 | 0 | 0 |

zone of deflagration ← | → zone of detonation

Figure 16:
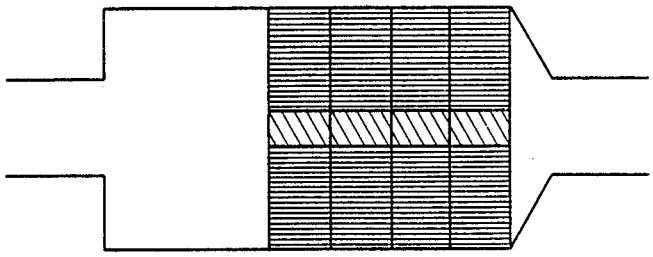

Having reference to FIG. 16, there is shown a schematic of an arrester B otherwise identical to arrester A but absent the attenuator. It was only tested for detonations and failed as shown in Table II.

TABLE II

| | | |
|---|---|---|
| Ignition location | #8 | 8 |
| Number of ignitions | 3 | 5 |
| Number of failures | 1 | 1 |
| | two separate tests | |

The attenuation of impinging shock waves was verified using quick response pressure transducers located as shown on FIG. 13. The strength of the inlet shock was determined by pressure measurement P1 on the inlet pipe immediately prior to entry into the flame arrester. The attenuated pressure P2 was measured just before the quenching element. Typical results were as follows:

TABLE III

| Ignition Location | P1 (psig) | P2 (psig) |
|---|---|---|
| #10 | 410 | 180 |
| #8 | 710 | 350 |

EXAMPLE II

Figure 18:
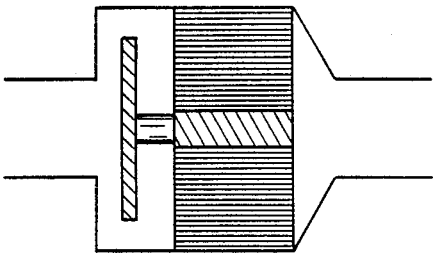
FIG. 18 shows schematically an arrester, having a single element segment and provided with a flat plate attenuator, used to develop the data of Example II.

This example compares burn test run results when an arrester having a flat disc, in accordance with FIG. 18, was used. With the flat disc in place as the attenuator, the results were as follows:

TABLE IV

| | |
|---|---|
| Ignition location | #10 |
| Number of ignitions | 5 |

TABLE IV-continued

| Number of failures | 5 |
|---|---|

Alternative Embodiments

Figure 17:
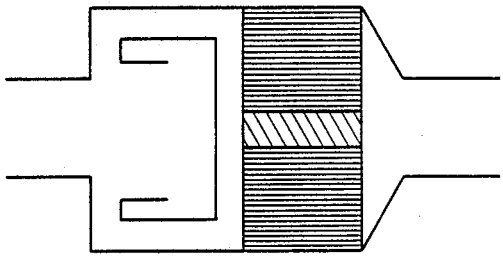
FIG. 17 shows schematically a preferred arrester having an attenuator formed with a bent back side wall.

An improved embodiment of the attenuator is illustrated in FIG. 17. In this embodiment, the sidewall 60 of the cup 61 is partly turned back to create an annular confined zone 62 for trapping a peripheral portion of the shock wave. The arrester of FIG. 17 corresponded with that of FIG. 20, except for the shape of the attenuator.

The modified entrance or mouth of this cup improves quenching of detonations. This was demonstrated by severe condition runs initiated from the ignition location (#10) most distant from the arrester and having a flame accelerator in the line. The results of testing two arresters, shown in FIGS. 17 and 20, were as follows:

TABLE V

Figure 20:
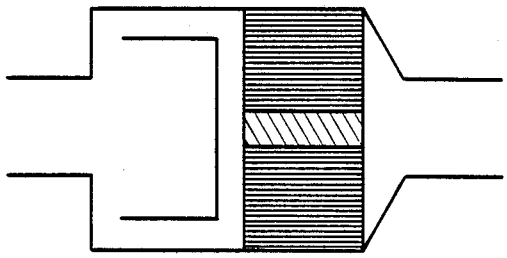
FIG. 20 shows schematically an arrester identical to that of FIG. 17 except that the attenuator does not have the bent back side wall, said arresters of FIGS. 17 and 20 being used to develop the data of Table V.

| Arrester Design | Ignition Location | Number of Ignitions | Number of Failures |
|---|---|---|---|
| FIG. 17 | #10 | 10 | 0 |
| FIG. 20 | #10 | 5 | 3 |

Figure 19:
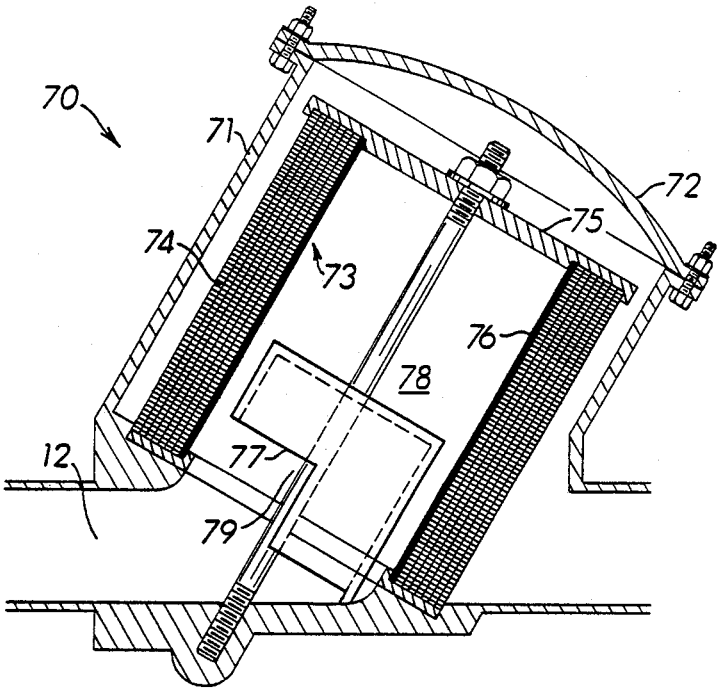
FIG. 19 shows another alternative form of arrester.

FIG. 19 shows another alternative form of arrester.

More particularly, FIG. 19 shows an arrester 70 having a tubular housing 71 closed at its upper end by a wall 72. A cylindrical element 73 is created by wrapping coiled expanded metal 74 around a support spool 75. The spool 75 has structural support bars 76 that run parallel to its axis. The expanded metal diamonds are all oriented in the same direction throughout the depth of the element 73. The cup 77 is situated in the space 78 formed by the hollow spool 75. The mouth 79 of the cup 77 is open toward the flame inlet 80.

In this configuration, the cup 77 acts to reduce the amount of pressure piling that results from the reflection of the incoming shock wave from the housing end wall 72.

The embodiments of the invention in which an exclusive property or privilege is claimed are defined as follows:

1. A flame arrester for arresting the advance of a flame front through a pipe line, comprising:

a generally tubular housing, said housing being adapted to be connected with the pipe line, whereby the housing forms an integral component thereof, said housing forming an inlet for a flame front advancing through the pipe line and an outlet, said housing thus forming an open-ended chamber;

element means, positioned in the chamber at its outlet end and extending transversely across the chamber, for quenching the flame attempting to pass therethrough; and a generally cup-shaped member, positioned in the chamber in line with and adjacent to but spaced from the inlet, said cup-shaped member being positioned between the inlet and the element means, said member having a solid end wall extending transversely across the inlet and a side wall, said side wall being spaced inwardly from the longitudinally extending wall of the housing, to form an annular passage therewith, said cup-shaped member having its mouth directed toward the inlet, said cup-shaped member being operative to receive the central portion of a detonation wave entering the chamber and to reflect part of it back into the pipe line.

2. The flame arrester as set forth in claim 1 wherein: the width of the mouth of the cup-shaped member is greater than the width of the housing inlet, whereby the cup-shaped member encircles the inlet.

3. The flame arrester as set forth in claim 2 wherein: the element comprises a stack of expanded metal sheets, each such sheet having a multiplicity of generally diamond-shaped openings having long and short widths, the sheets being alternately juxtapositioned so that a sheet has its opening long dimension rotated at about 90° relative to the next adjacent sheet.

4. The flame arrester as set forth in claim 1 wherein: the element comprises a stack of expanded metal sheets, each such sheet having a multiplicity of generally diamond-shaped openings having long and short widths, the sheets being alternately juxtapositioned so that a sheet has its opening long dimension rotated at about 90° relative to the next adjacent sheet.

5. A flame arrester for arresting the advance of a flame front through a pipe line, comprising:

a generally tubular housing, said housing being adapted to be connected with the pipe line whereby the housing forms an integral component thereof, said housing forming an inlet for a flame front advancing through the pipe line, said housing further forming an open-ended chamber of expanded diameter relative to the pipe line with which it is to be used;

element means, positioned in the housing at its outlet end and extending transversely fully across the housing chamber, for quenching the flame attempting to pass therethrough, said element means comprising a matrix forming a multiplicity of discrete channels extending therethrough generally in the direction of the longitudinal axis of the housing, each such channel having a width les than the diameter required for quenching a flame front in the deflagration mode; and detonation attenuating means for receiving the central portion of a detonation wave entering the chamber and reflecting it, said means being positioned in the chamber at its inlet end and comprising a generally cup-shaped member having its mouth directed toward the inlet, said cup-shaped member having its side wall inwardly spaced from the longitudinally extending wall of the housing to form an annular passage therewith, the width of the mouth of the cup-shaped member being greater than the width of the inlet whereby the cup-shaped member encircles the inlet, the first end of the cup-shaped member being spaced from the adjacent end wall of the housing, whereby a peripheral portion of the flame front may enter the annular passage and reach the element means.

6. The flame arrester as set forth in claim 5 wherein: the element comprises a stack of expanded metal sheets, each such sheet having a multiplicity of generally diamond-shaped openings having long and short widths, the sheets being alternately juxtapositioned so that a sheet has its opening long dimension rotated at about 90° relative to the next adjacent sheet.

* * * * *